United States Patent [19]

Jacobsson

[11] 3,994,446

[45] Nov. 30, 1976

[54] THREAD SUPPLY DEVICE FOR TEXTILE MACHINES

[75] Inventor: Kurt Arne Gunnar Jacobsson, Ulricehamn, Sweden

[73] Assignee: Aktiebolaget IRO, Ulricehamn, Sweden

[22] Filed: Apr. 17, 1975

[21] Appl. No.: 569,147

[30] Foreign Application Priority Data

Apr. 24, 1974 Germany ..... 2419793

[52] U.S. Cl. ..... 242/47.01; 242/47.12; 66/132 R

[51] Int. Cl.² ..... B65H 51/20

[58] Field of Search ..... 242/47.01, 47.03, 48, 242/47.12; 66/132

[56] References Cited

UNITED STATES PATENTS

| | | | |
|---|---|---|---|
| 3,490,710 | 1/1970 | Mühlhäusler | 242/47.01 |
| 3,908,921 | 9/1975 | Jacobsson | 242/47.12 |

*Primary Examiner*—Richard E. Aegerter
*Assistant Examiner*—Willis Little
*Attorney, Agent, or Firm*—Woodhams, Blanchard and Flynn

[57] ABSTRACT

A thread supply device, as for a textile machine, having a stationary thread drum onto which a thread which comes from a storage bobbin can be wound tangentially by means of a winding-on member which rotates around the drum edge for forming an intermediate thread supply on the drum. The thread can be pulled off the drum through a central withdrawal eye. A thread control element is arranged in the area of the withdrawal path of the thread. The thread control element has the form of a hook and is secured on the winding-on member. The hook receives the withdrawal thread in its mouth to limit the thread withdrawal speed to the thread winding-on speed. In the thread withdrawal path, downstream of the hook, there is provided a cut-off eye arranged on a swivel arm which can be swung transversely to the thread path from an operating position into a nonuse or shut-off position. This arm is hinged to the rotating winding-on member and swivels about an axis which is substantially aligned with the axis of the drum.

5 Claims, 3 Drawing Figures

THREAD SUPPLY DEVICE FOR TEXTILE MACHINES

BACKGROUND OF THE INVENTION

The invention relates to a thread supply device for textile machines, in particular knitting machines, comprising a stationary thread drum onto which a thread which comes from a storage bobbin can be wound tangentially by means of a winding-on member rotating around the drum edge for forming an intermediate thread supply and from which the thread can be pulled downwardly through a central withdrawal eye, and further comprising a thread control element arranged in the area of the withdrawal path of the thread and having the form of a hook secured on the winding-on member, which hook receives the unwinding thread in its hook mouth and through this limits the withdrawal speed to the winding-on speed.

The basic purpose of the invention is to further develop a thread supply device of the above-described type so that it permits an indication of an undesired strong drop of the withdrawal tension.

This purpose is attained according to the invention by providing a cut-off eye in the thread path downstream of the hook, which eye is arranged on a swivel arm which can be swung transversely relative to the thread path from an operating position into a nonuse or shut-off position, and which arm is hinged to the rotating winding-on member and the swivel axis of which coincides with the axis of the thread drum.

The invention takes advantage of the following situation: in a thread supply device of the described type, the thread which is withdrawn downwardly from the thread drum during a positive thread delivery operation laterally rests against a thread control element, such as a hook. This lateral engagement of the thread on the thread control element is created because the withdrawn thread tries to run around the thread drum due to the withdrawal tension of the thread. However, this movement of the withdrawal thread is prevented by the thread control element. Thus, only as much thread can be withdrawn as is released by the rotation of the thread control element, which thread control element rotates together with the winding-on member around the thread drum. In this manner, the point at which the thread is withdrawn downwardly from the thread drum rotates at the same speed as the winding-on member or as the thread control element. If the tension in the withdrawn thread drops, then less thread is withdrawn from the thread drum than is released based on the rotation of the thread control element. Since the thread control element rotates together with the winding-on member at an unchanged speed, the withdrawn thread will trail or fall behind the thread control element, or may even stop at one point (in the case of an extremely strong drop in the withdrawal tension). Under these conditions, the withdrawal thread will retard the swivel arm of the cut-off eye in its rotation, which swivel arm usually rotates uniformly with the thread control element, and will thus swing the cut-off eye from its operating position into the nonuse or shut-off position. Thus, the swivelling of the cut-off eye and of the swivel arm can be utilized to indicate a decrease in the thread withdrawal tension or to stop the respectively supplied textile machine.

BRIEF DESCRIPTION OF THE DRAWINGS

One exemplary embodiment of the invention is illustrated hereinafter in the drawing, in which.

DETAILED DESCRIPTION

Figure 1:
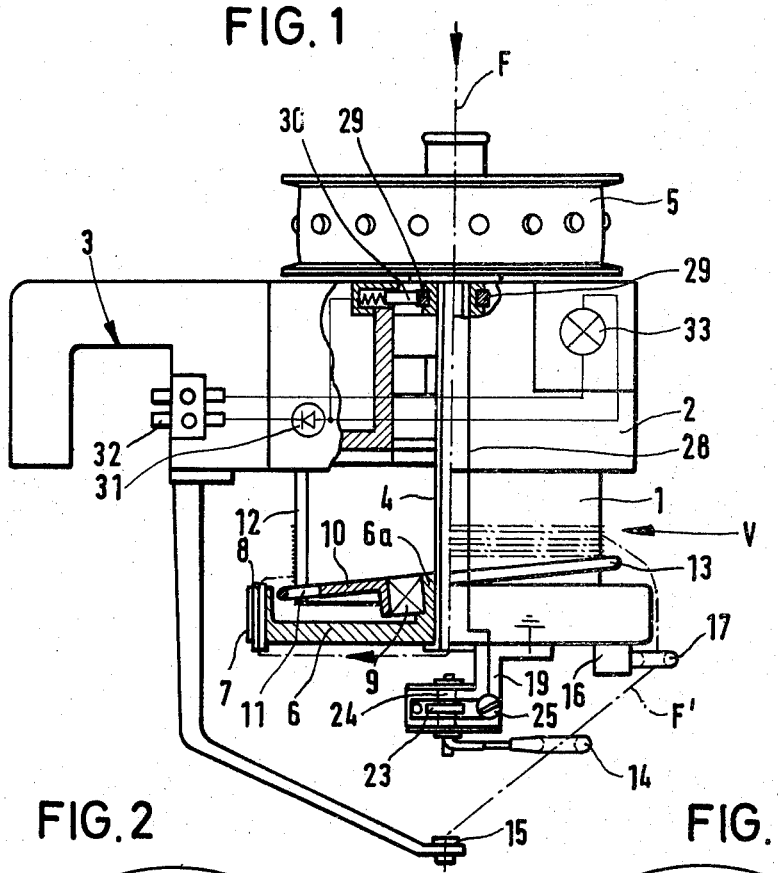
FIG. 1 is a side view, partially in cross section, of the inventive thread supply device.

In the drawing, 1 is a thread drum which is fixed with respect to a housing 2. The housing 2 is clamped on a support ring of a textile machine (not shown) by means of a clamping device which is schematically indicated at 3. A hollow shaft 4 extends through and is rotatably supported relative to the drum 1 and the housing 2. Shaft 4 has a pin wheel 5 nonrotatably secured to the upper end thereof. Pin wheel 5 is driven by a perforated drive belt (not shown) in order to rotatably drive the hollow shaft 4. A disk 6 is nonrotatably connected to the lower end of the shaft 4. Disk 6 has a flangelike ring 7 on its outer edge which surrounds the lower free edge of the thread drum 1. The ring 7 contains a thread eye 8. The parts 6 to 8 form a rotating winding-on member for the thread F issuing from a supply bobbin (not shown), which thread passes through the hollow shaft 4, is then deflected radially outwardly, is guided through the thread eye 8 and is wound tangentially onto the thread drum 1. A ball bearing 9 is supported in an inclined position on the hub 6*a* of the disk 6. A thread displacement disk 10 is supported on the ball bearing 9. The disk 10 has arms 11 which extend outwardly through longitudinal slots 12 in the surface of the thread drum 1. The arms 11 are interconnected on the outside of the drum by a ring 13.

Due to the inclined arrangement of the displacement disk 10 relative to the disk 6, the displacement disk 10 undergoes a wobbling movement during rotation of the hollow shaft 4 and of the winding-on member 6 which is fixed with respect to the shaft 4. This wobbling movement of disk 10 pushes the thread windings on the thread drum 1 upwardly in the axial direction of the thread drum so that an intermediate thread supply V is formed on the drum.

The thread is withdrawn from the drum 1 downwardly from the intermediate supply V, as indicated at F′. The withdrawn thread F′ passes over the outer surface of the ring 7, then passes through a cut-off eye 14, and from there passes through a central withdrawal eye 15.

Figure 2:
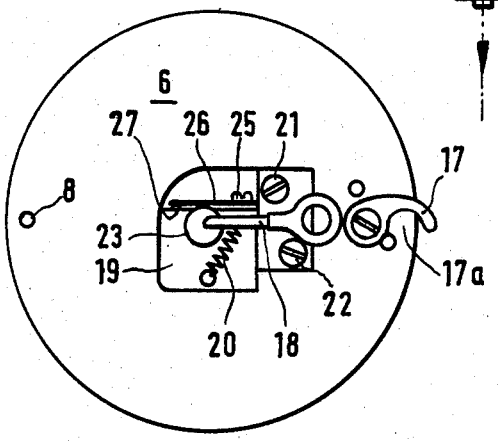
FIG. 2 is a bottom view of the thread supply device shown in FIG. 1 having a swivel arm which is in an operating position.

A hook 17 is journaled on the underside of the disk 6 so as to be pivotal about a vertical axis 16. The hook 17, as seen from FIG. 2, has the mouth 17*a* projectly radially beyond the periphery of the disk 6. During normal withdrawal tension, the thread F′ rests against the inside of the hook mouth 17*a*. However, the hook 17 can be pivoted inwardly from the position shown in the drawings into a position wherein the hook mouth 17*a* is within the periphery of the disk 6, insofar as this is desired for example for repair or adjusting purposes.

Figure 3:
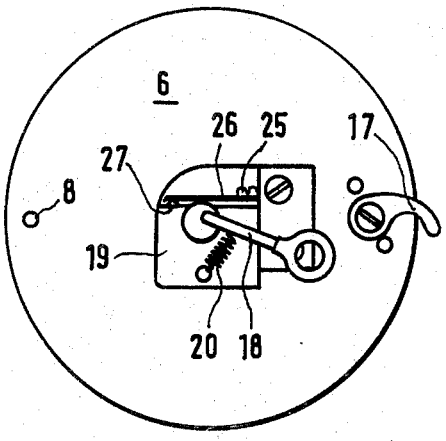
FIG. 3 is a bottom view of the thread supply device shown in FIG. 1 having a swivel arm which is in a nonuse position.

The cut-off eye 14 is arranged on a swivel arm 18 which can be swung from an operating position into a nonuse position. Arm 18 is pivotally supported on a support 19 which is fixed to the rotatable winding-on disk 6. The swivel axis of arm 18 is aligned with the longitudinal axis of the thread drum 1, which axis also defines the axis of rotation for the shaft 4. The swivel arm 18 is shown in its operating position in FIG. 2 and in its nonuse or shut-off position in FIG. 3. A tension spring 20 which is secured on the support 19 engages said swivel arm, which spring urges arm 18 from its operating position into its nonuse position. The support 19 is releasably secured on the disk 7 by means of screws 21 and 22. This arrangement assures that the cut-off eye 14 rotates synchronously with the hook 17 which is also fixedly mounted on the winding-on member 6. A circular electrical contact disk 23 is eccentrically fixed on a shaft 24 which is rotatably supported by the support 19. The shaft 24 is fixed to the arm 18 and defines the swivel axis thereof. The contact disk 23 is connected through the winding-on member 6 to the earth potential. An electrical contact plate 26 is arranged on the support 19 by means of a screw 25. The contact plate 26 is electrically insulated from the support 19, as for example by means of an insulating sleeve around the screw 25 and an insulating dent or projection 27. The contact plate 26 is connected through an electrical cable 28, a slip ring 29, a slip ring brush 30, a diode 31, a contact pin 32, and a relay (not illustrated in the drawing) to a current source for turning off the textile machine. If the textile machine has several thread supply devices associated therewith, then a common electrical cable leads from the thread supply devices to the current source.

An indicating lamp 33 is also connected to this current source.

If the withdrawal tension of the thread F′ is reduced, the thread F′ leaves the mouth of the hook 17. The movement of the thread cooperates with the force of the spring 20 so that the cut-off eye 14 swings from the operating position shown in FIG. 2 into the nonuse position shown in FIG. 3. The contact disk 23 which is fixedly arranged on the shaft 24 of the swivel arm 18 also rotates therewith. Due to its eccentric placement on the shaft 24, contact 23 moves into electric contact with the contact plate 26 when arm 18 swings into the nonuse position of FIG. 3. The engagement of contacts 23 and 26 causes the relay (not shown) to be energized so as to turn off or shut down the textile machine. At the same time current flows through the indicating lamp 33 and same lights up. The diode 31 prevents the indicating lamps of adjacent thread supply devices from lighting up, when the cut-off eye 14 of only one thread supply device is operated.

I claim:

1. In a thread supply device for a textile machine, in particular a knitting machine, comprising a stationary thread drum, winding means associated with the drum for winding a thread which is supplied from a storage bobbin onto the drum for forming an intermediate thread supply thereon, the winding means including a winding-on member rotatably supported for rotation around the edge of the drum to wind the thread tangentially onto the drum, a withdrawal eye spaced from the drum and through which the thread withdrawn from the drum passes, and a thread control element secured on the winding-on member and arranged in the area of the withdrawal path of the thread, the thread control element having the form of a hook for receiving the withdrawn thread and for limiting the thread withdrawal speed from the drum to the thread winding-on speed on the drum, the improvement comprising cut-off means associated with the withdrawn thread for sensing a reduction in the tension of said withdrawn thread, said cut-off means including a cut-off eye disposed in engagement with the withdrawn thread at a point disposed between the hook of the thread control element and the withdrawal eye, a swivel arm having said cut-off eye mounted thereon with said swivel arm being swingable transversely relative to the path of the withdrawn thread from an operating position wherein the cut-off eye engages the withdrawn thread into a nonuse position, the movement of said cut-off eye from said operating position toward said nonuse position occurring in substantially the same direction as the movement of the withdrawn thread when it leaves said hook of the thread control element due to a slackening in the tension of the withdrawn thread, and spring means coacting with the cut-off eye for normally urging same away from said operating position toward said nonuse position.

2. A thread supply device according to claim 1, wherein said swivel arm is swingably mounted on said winding-on member for swinging movement about an axis which is substantially aligned with the axis of the thread drum.

3. A thread supply device according to claim 1, wherein the withdrawal eye is spaced axially from one end of said drum and is disposed substantially in alignment with the axis of said thread drum, the withdrawn thread after passing through the hook of said thread control element passing axially outwardly away from the thread drum and radially inwardly relative to the axis thereof so as to pass through the withdrawal eye, and said withdrawn thread as it extends between said hook and said withdrawal eye being engaged solely by said cut-off eye.

4. A thread supply device according to claim 3, wherein the point of engagement between the cut-off eye and the withdrawn thread is disposed relative to said drum axis radially outwardly from said withdrawal eye and radially inwardly from said hook.

5. In a thread supply device for a textile machine, in particular a knitting machine, comprising stationary drum means upon which a thread can be tangentially wound to form an intermediate thread storage and from which the thread can be unwound axially over a withdrawal rim associated with the drum means, a stationary thread guide member disposed in substantial alignment with the longitudinal axis of said drum means for guiding the thread withdrawn from said drum means after it passes over the withdrawal rim, rotatable winding means coacting with said drum means for winding the thread onto said drum means to form said intermediate thread supply, said winding means including a ringlike member supported for rotation about the longitudinal axis of said drum means and defining said withdrawal rim, and thread control means positioned adjacent the withdrawal rim of said drum means for engaging the thread being withdrawn from said drum means to limit the rate of withdrawal of thread from said drum means substantially to the rate at which thread is wound on the drum means, the thread control means comprising a hook-shaped thread control member mounted on the ringlike member and having the mouth thereof disposed adjacent the withdrawal rim, the improvement comprising a cut-off member pivotally mounted on the ringlike member and swingably movable in a direction which is substantially transverse to the withdrawn thread as it extends between the thread control member and said thread guide member, said cut-off member having a hook portion which engages the withdrawn thread at a location disposed radially between the withdrawal rim and the longitudinal axis of said drum means, the withdrawn thread as it extends from the thread control member to the thread guide member being engaged solely by said hook portion, said cut-off member being swingably movable from an operative position when a proper tension exists in the withdrawn thread to a nonuse position when the tension in the withdrawn thread slackens, and biasing means for normally urging said cut-off member toward said nonuse position.

* * * * *